US007497445B1

(12) United States Patent
Colgan

(10) Patent No.: US 7,497,445 B1
(45) Date of Patent: Mar. 3, 2009

(54) INLINE SKATE WHEEL ASSEMBLY

(76) Inventor: Daniel J. Colgan, 4075 Parker Rd., Fort Gratiot, MI (US) 48059

( * ) Notice: Subject to any disclaimer, the term of this patent is extended or adjusted under 35 U.S.C. 154(b) by 479 days.

(21) Appl. No.: 11/232,141

(22) Filed: Sep. 22, 2005

(51) Int. Cl.
*A63C 17/04* (2006.01)

(52) U.S. Cl. ..... 280/11.223; 280/11.221; 280/11.227; 280/11.231; 280/11.27

(58) Field of Classification Search ..... 280/11.221, 280/11.223, 11.227, 11.231, 11.27
See application file for complete search history.

(56) References Cited

U.S. PATENT DOCUMENTS 5,351,974 A * 10/1994 Cech ..... 280/11.212
5,470,086 A * 11/1995 Peterson et al. ..... 280/11.223
5,564,790 A * 10/1996 Lekavich ..... 301/5.306
5,573,309 A * 11/1996 Bekessy ..... 301/5.303
5,720,529 A 2/1998 Barron
D401,298 S 11/1998 Portzline
5,897,170 A * 4/1999 Keleny ..... 301/5.307
5,997,018 A 12/1999 Lee
6,065,760 A * 5/2000 Weygandt ..... 280/11.19
6,176,554 B1 * 1/2001 Huang ..... 301/5.7
6,543,791 B1 * 4/2003 Lee ..... 280/11.223
6,578,930 B1 6/2003 Alderman et al.
2002/0011712 A1 * 1/2002 Svensson et al. ..... 280/11.27
2004/0160024 A1 * 8/2004 Liu ..... 280/11.223

* cited by examiner

*Primary Examiner*—Christopher P Ellis
*Assistant Examiner*—Jacob Meyer

(57) ABSTRACT

An inline skate wheel assembly includes a loop that has a centrally disposed opening extending therethrough. The loop has an inner perimeter surface having a ring integrally attached thereto. A hub assembly includes a cylinder that has a first end and a second end. The first and second ends are open. A first perimeter flange is attached to an outer surface of the cylinder and abuts the first end. A second perimeter flange is attached to the outer surface of the cylinder and abuts the second end. The cylinder has a break therein so that a first portion and a second portion of the cylinder are defined. An axle may be extended through the cylinder when the first and second portions are extended into the loop and abutted against the ring so that the cylinder is rotatably mounted on the axle. The axle is secured to an inline skate track.

4 Claims, 5 Drawing Sheets

INLINE SKATE WHEEL ASSEMBLY

BACKGROUND OF THE INVENTION

1. Field of the Invention

The present invention relates to wheel devices and more particularly pertains to a new wheel device for an inline skate that includes a removable hub that may be removed and inserted into a new outer wheel when the outer wheel wears out.

2. Description of the Prior Art

The use of wheel devices is known in the prior art. U.S. Pat. No. 6,176,554 describes a wheel assembly for positioning on an inline skate. Another type of wheel device is U.S. Pat. No. 5,564,790 having a design adapted for being positioned on an inline skate. Yet another such wheel assembly is found in U.S. Pat. No. 5,720,529.

While these devices fulfill their respective, particular objectives and requirements, the need remains for a device that allows for easy interchange of outer wheels from a hub attached to an inline skate. Additionally, the device should be stable to ensure that the hub does not rotate with respect to the outer wheel.

SUMMARY OF THE INVENTION

The present invention meets the needs presented above by generally comprising a loop that has a centrally disposed opening extending therethrough. The loop defines a wheel and has an outer perimeter surface, an inner perimeter surface, a first lateral side and a second lateral side. A ring is integrally attached to and is coextensive with the inner perimeter surface. The ring is coaxial with the loop and is positioned between and is spaced from the first and second lateral sides. The ring has a first side edge, a second side edge and an inner edge. The inner edge has a plurality of elongated cavities therein extending between and through each of the first and second side edges. A hub assembly is configured to be removably attached to the loop. The hub assembly includes a cylinder having a first end and a second end. The first and second ends are open. A first perimeter flange is attached to an outer surface of the cylinder and abuts the first end. A second perimeter flange is attached to the outer surface of the cylinder and abuts the second end. A plurality of raised sections is attached to the outer surface and extends between the first and second flanges. Each of the raised sections is positionable in one of the elongated cavities. The first flange has a plurality of elongated wells extending therein. The wells each extend through one of the elongated raised sections and outwardly of the second flange. The cylinder has a break therein that extends through the raised sections so that a first portion and a second portion of the cylinder are defined. Each of plurality of fasteners is removably extendable through one of the elongated cavities and securing the first portion to the second portion when each of the first and second flanges is abutted against one of the first and second side edges of the ring. An axle is extended through the cylinder such that the cylinder is rotatably mounted on the axle. The axle is secured to the inline skate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
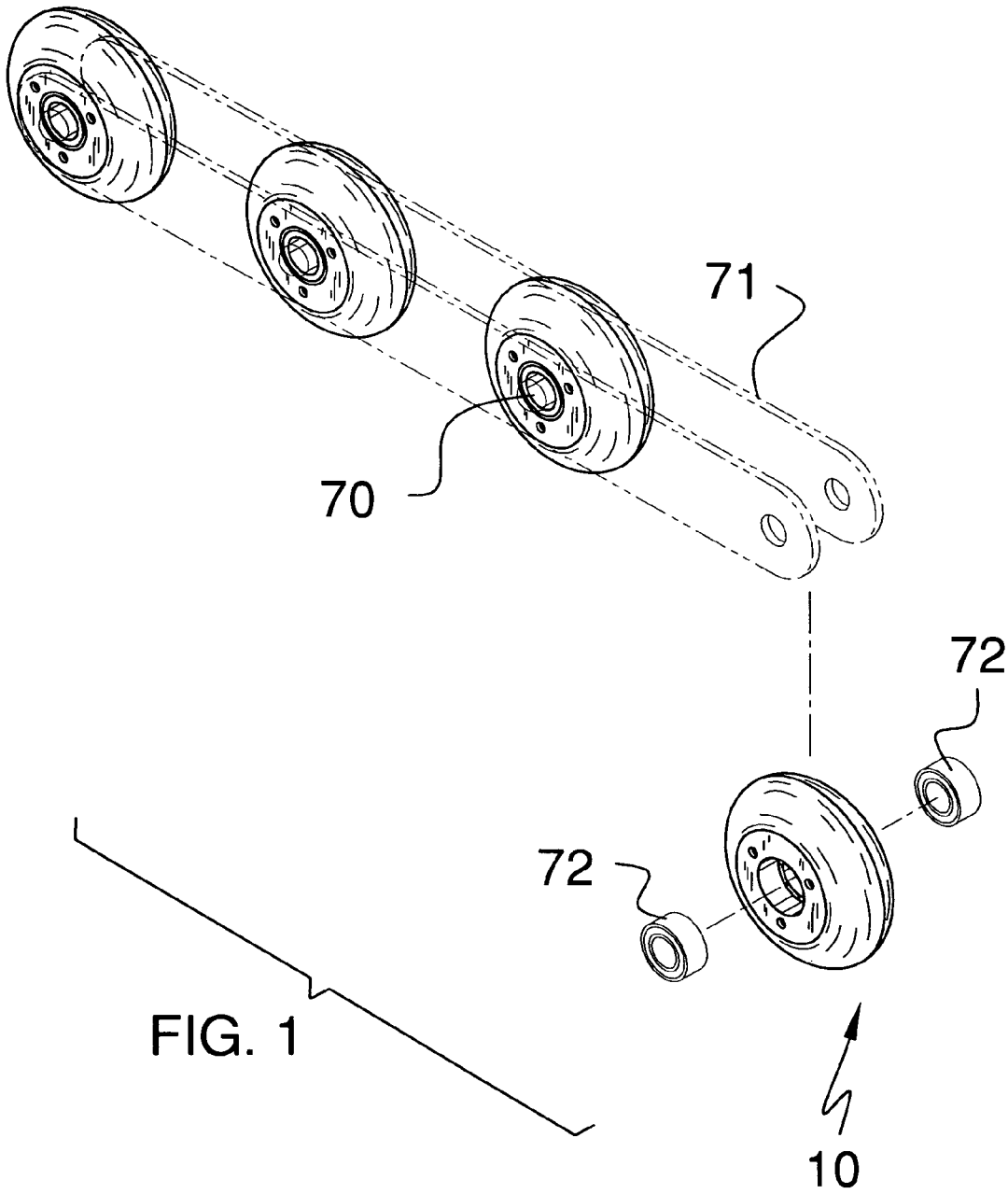
FIG. 1 is a perspective view of an inline skate wheel assembly according to the present invention.
Figure 2:
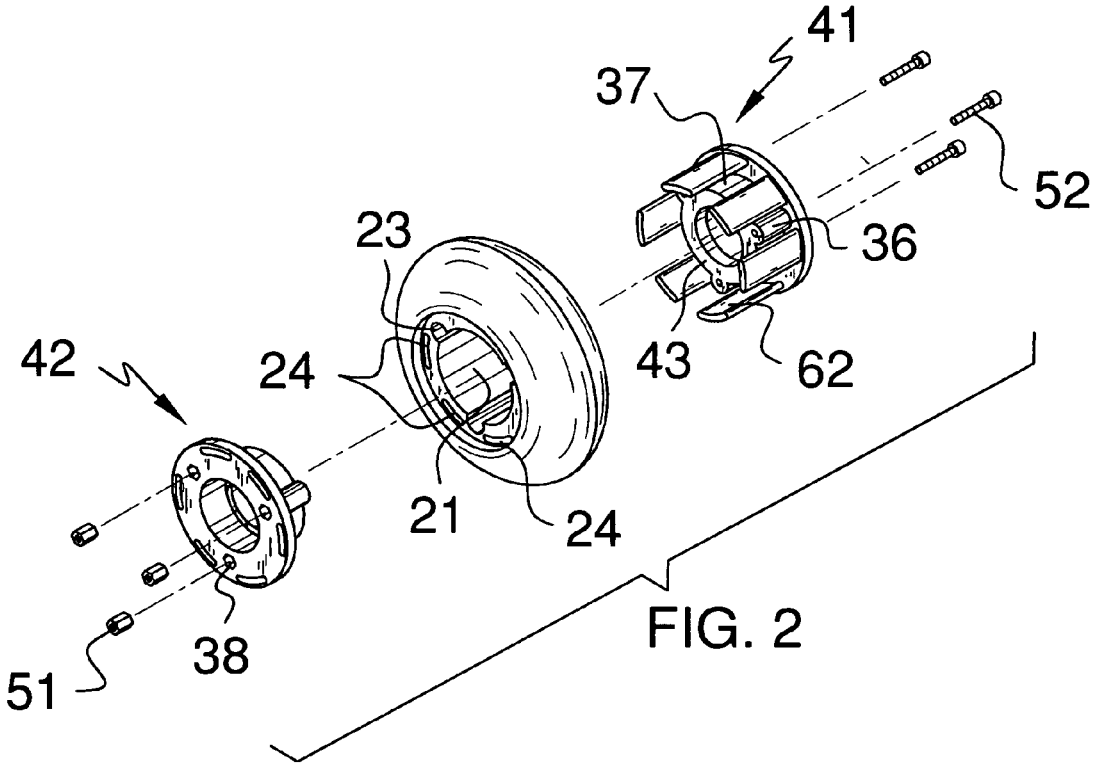
FIG. 2 is a first side perspective view of the present invention.
Figure 3:
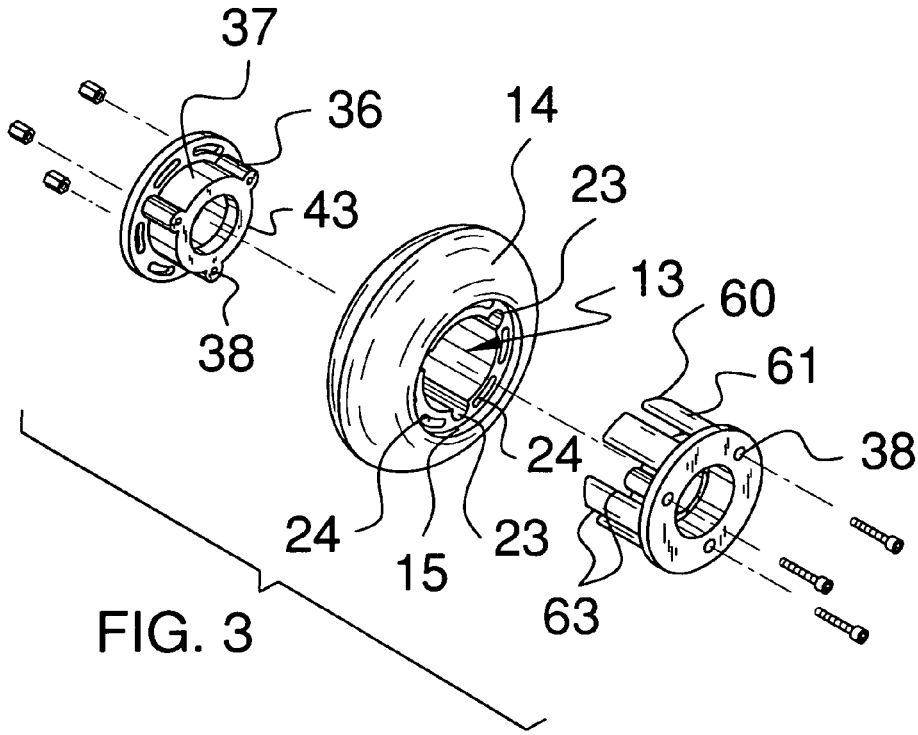
FIG. 3 is a second side perspective view of the present invention.
Figure 4:
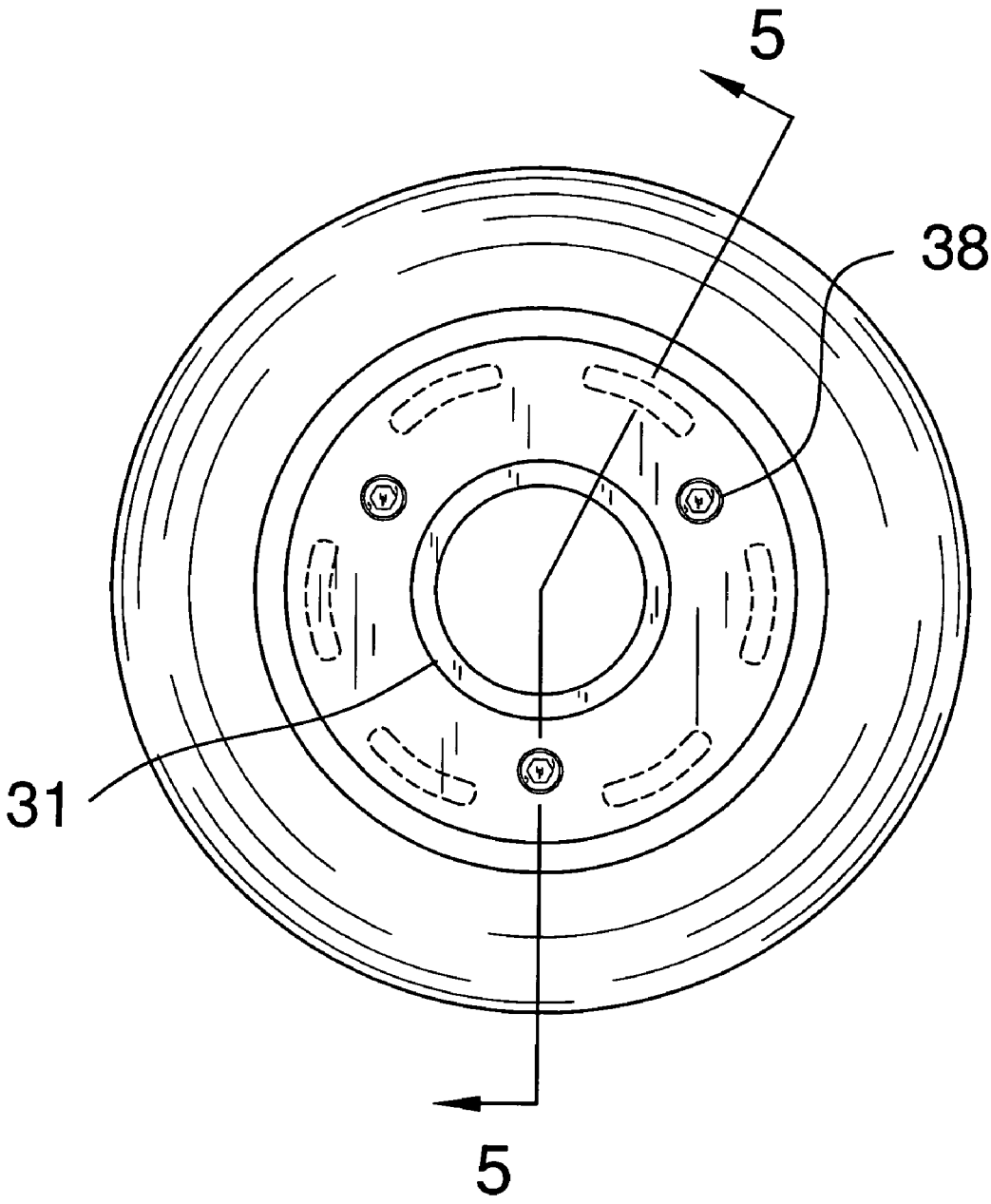
FIG. 4 is a side view of the present invention.
Figure 5:
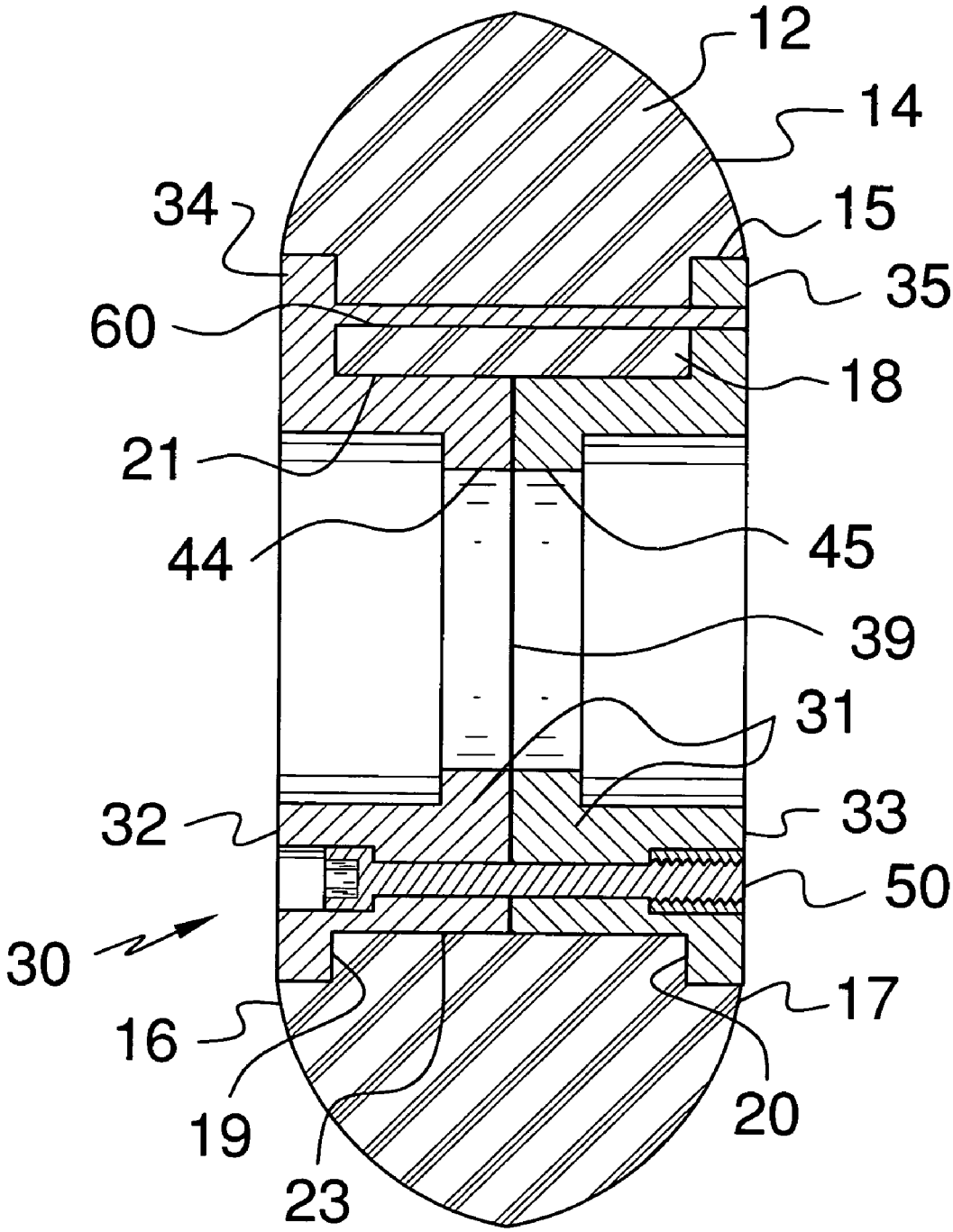
FIG. 5 is a cross-sectional view taken along line 5-5 of FIG. 4 of the present invention.
Figure 6:
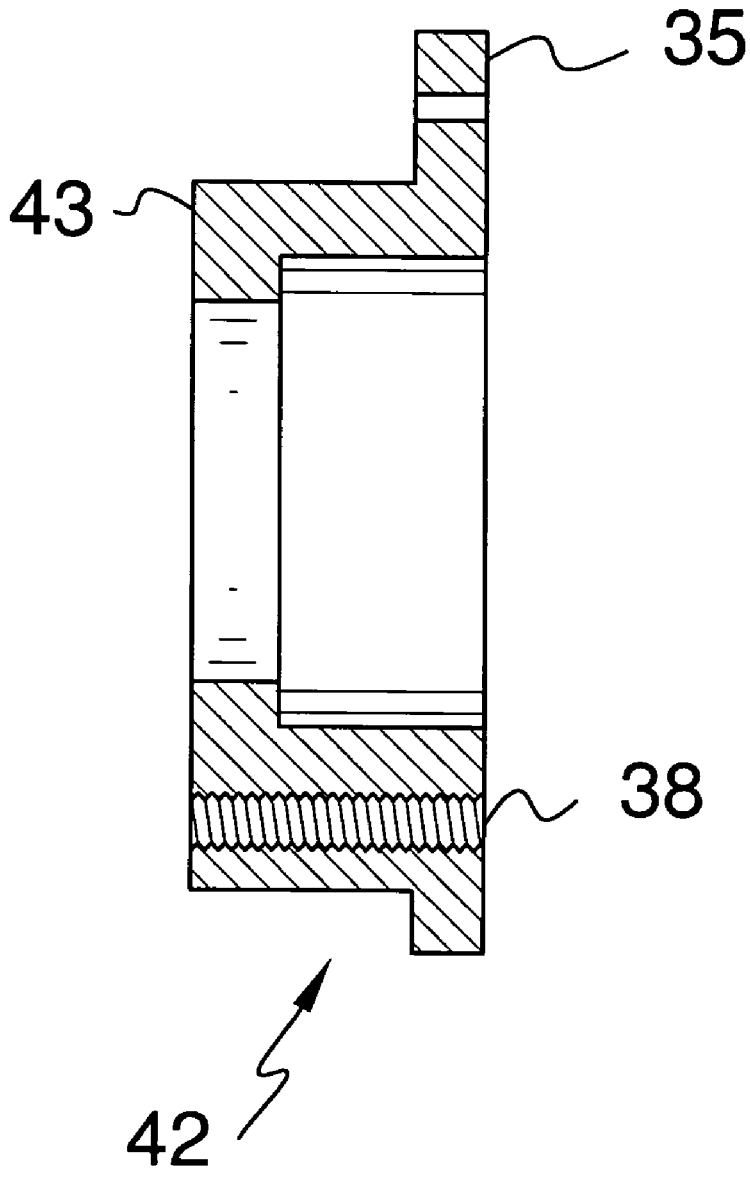
FIG. 6 is a cross-sectional view of a portion of a hub of the present invention.

With reference now to the drawings, and in particular to FIGS. 1 through 6 thereof, a new wheel device embodying the principles and concepts of the present invention and generally designated by the reference numeral 10 will be described.

As best illustrated in FIGS. 1 through 6, the inline skate wheel assembly 10 generally comprises a loop 12 that has a centrally disposed opening 13 extending therethrough. The loop 12 defines a wheel and is preferably comprised of a conventional plastic or elastomer used for inline skate wheels. The loop 12 has an outer perimeter surface 14, an inner perimeter surface 15, a first lateral side 16 and a second lateral side 17. A ring 18 is integrally attached to and is coextensive with the inner perimeter surface 15. The ring 18 is coaxial with the loop 12 and is positioned between and is spaced from the first 16 and second 17 lateral sides. The ring 18 has a first side edge 19, a second side edge 20 and an inner edge 21. The inner edge 21 has a plurality of elongated cavities 23 therein extending between and through each of the first 19 and second 20 side edges. The elongated cavities 23 each have a convexly arcuate surface. A plurality of apertures 24 extends into the first side edge 19 and outwardly of the second side edge 20. The apertures 24 are generally equally spaced from each other.

A hub assembly 30 is configured to be removably attached to the loop 12. The hub assembly 30 includes a cylinder 31 that has a first end 32 and a second end 33. The first 32 and second 33 ends are open. A first perimeter flange 34 is attached to an outer surface 37 of the cylinder 31 and abuts the first end 32. A second perimeter flange 35 is attached to the outer surface 37 of the cylinder 31 and abuts the second end 33. A plurality of raised sections 36 is attached to the outer surface 37 and extends between the first 34 and second 35 flanges. Each of the raised sections 36 is positionable in one of the elongated cavities 23. The first flange 34 has plurality of an elongated wells 38 extending therein. Each of the wells 38 extends through one of the elongated raised sections 36 and outwardly of the second flange 35. The cylinder 31 has a break 39 therein that extends through the raised sections 36 so that a first portion 41 and a second portion 42 of the cylinder 31 is defined. Each of the first 41 and second 42 portions has a distal edge 43 with respect to the first 34 and second 35 flanges. An inwardly extending first perimeter lip 44 is attached to the distal edge 43 of the first portion 41 and an inwardly extending second perimeter lip 45 is attached to the distal edge 43 of the second portion 42.

A plurality of fasteners 50 is provided. Each of the fasteners 50 is removably extendable through one of the elongated cavities 38 and secures the first portion 41 to the second portion 42 when each of the first 34 and second 35 flanges is abutted against one of the first 19 and second 20 side edges of the ring 18. The first 19 and second 20 flanges preferably have a same depth as a distance from the first 19 and second 20 side edges of the ring 18 to the first 16 and second 17 lateral sides of the loop 12. The fasteners 50 each preferably include a hex bolt 51 and a threaded rod 52. The portion of the cavity 38 in the section portion may have a same size and shape as the hex bolt 51 to prevent rotation of the hex bolt 51.

A plurality of posts 60 is provided. Each of the posts 50 is attached to the first flange 34 and extends toward and through the second flange 35 when the first 41 and second 42 portions are secured together. Each of the posts 60 is extendable through one of the apertures 24. The posts 60 each have an outer side 61, an inner side 62 and a pair of lateral edges 63. Each of the outer 61 and inner 62 sides is arcuate and each of the apertures 24 has same shape and size as the posts 60. The outer sides 61 are preferably convex while the inner sides 62 are preferably concave. This shape adds strength and stability to the cylinder 31 when it is attached to the ring 18.

In use, an axle 70 is extended through the cylinder 31 so that the cylinder 31 is rotatably mounted on the axle 70. The axle 31 is secured to the inline skate track 71 and is positioned in a pair of annular saddles 72, each having bearings therein, that sit within the cylinder 31 and are abuttable against the first 44 and second 45 perimeter lips. When the loop 12, or wheel, wears out, the hub assembly 30 may be removed and inserted into a new loop 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inline skate wheel assembly for being rotatably attached to an inline skate, said assembly comprising:

a loop having a centrally disposed opening extending therethrough, said loop defining a wheel, said loop having an outer perimeter surface, an inner perimeter surface, a first lateral side and a second lateral side, a ring being integrally attached to and being coextensive with said inner perimeter surface, said ring being coaxial with said loop and being positioned between and being spaced from said first and second lateral sides, said ring having a first side edge, a second side edge and an inner edge, said inner edge having a plurality of elongated cavities therein extending between and through each of said first and second side edges;

a hub assembly being configured to be removably attached to said loop, said hub assembly including a cylinder having a first end and a second end, said first and second ends being open, a first perimeter flange being attached to an outer surface of said cylinder and abutting said first end, a second perimeter flange being attached to an opposite side of said outer surface of said cylinder and abutting said second end, a plurality of raised sections being attached to said outer surface and extending between and abutting said first and second flanges, each of said raised sections being positionable in one of said elongated cavities, said first flange having a plurality of elongated wells extending therein, each of said plurality of elongated wells extending through one of said plurality of raised sections and outwardly of said second flange, said cylinder having a break therein and extending through said raised sections such that a first portion and a second portion of said cylinder are defined;

a plurality of fasteners, each of said fasteners being removably extendable through one of said elongated cavities and securing said first portion to said second portion when each of said first and second flanges is abutted against one of said first and second side edges of said ring;

wherein an axle may be extended through said cylinder such that said cylinder is rotatably mounted on said axle, the axle being secured to an inline skate track.

2. The assembly according to claim 1, wherein said inner edge has a plurality of elongated cavities therein extending between and through each of said first and second side edges, a plurality of apertures extending into said first side edge and outwardly of said second side edge, a plurality of posts, each of said posts being attached to said first flange and extending toward and through said second flange when said first and second portions are secured together, each of said posts being extendable through one of said apertures.

3. The assembly according to claim 1, wherein each of said first and second portions having a distal edge with respect to said first and second flanges, an inwardly extending first perimeter lip being attached to said distal edge of said first portion, an inwardly extending second perimeter lip being attached to said distal edge of said second portion.

4. An inline skate wheel assembly for being rotatably attached to an inline skate, said assembly comprising:

a loop having a centrally disposed opening extending therethrough, said loop defining a wheel, said loop having an outer perimeter surface, an inner perimeter surface, a first lateral side and a second lateral side, a ring being integrally attached to and being coextensive with said inner perimeter surface, said ring being coaxial with said loop and being positioned between and being spaced from said first and second lateral sides, said ring having a first side edge, a second side edge and an inner edge, said inner edge having a plurality of elongated cavities therein extending between and through each of said first and second side edges, a plurality of apertures extending into said first side edge and outwardly of said second side edge, said apertures being generally equally spaced from each other;

a hub assembly being configured to be removably attached to said loop, said hub assembly including a cylinder having a first end and a second end, said first and second ends being open, a first perimeter flange being attached to an outer surface of said cylinder and abutting said first end, a second perimeter flange being attached to an opposite side of said outer surface of said cylinder and abutting said second end, a plurality of raised sections being attached to said outer surface and extending between and abutting said first and second flanges, each of said raised sections being positionable in one of said elongated cavities, said first flange having a plurality of elongated wells extending therein, each of said plurality of elongated wells extending through one of said plurality of raised sections and outwardly of said second flange, said cylinder having a break therein and extending through said raised sections such that a first portion and a second portion of said cylinder are defined, each of said first and second portions having a distal edge with respect to said first and second flanges, an inwardly extending first perimeter lip being attached to said distal edge of said first portion, an inwardly extending second perimeter lip being attached to said distal edge of said second portion;

a plurality of fasteners, each of said fasteners being removably extendable through one of said elongated cavities and securing said first portion to said second portion when each of said first and second flanges is abutted against one of said first and second side edges of said ring;

a plurality of posts, each of said posts being attached to said first flange and extending toward and through said second flange when said first and second portions are secured together, each of said posts being extendable through one of said apertures, each of said posts having an outer side, an inner side and a pair of lateral edges, each of said outer and inner sides being arcuate, each of said apertures having same shape and size as said posts, each of said outer sides being convex, each of said inner sides being concave;

wherein an axle may be extended through said cylinder such that said cylinder is rotatably mounted on said axle, the axle being secured to an inline skate track.

* * * * *